US006152055A

United States Patent [19]

Beverly

[11] Patent Number: 6,152,055

[45] Date of Patent: Nov. 28, 2000

[54] TUFTING MACHINE NEEDLE

[75] Inventor: Ian Beverly, Blackburn, United Kingdom

[73] Assignee: Spencer Wright Industries, Inc., Dalton, Ga.

[21] Appl. No.: 09/267,488

[22] Filed: Mar. 11, 1999

[30] Foreign Application Priority Data

Nov. 27, 1998 [GB] United Kingdom ..... 9825978

[51] Int. Cl.[7] ..... D05C 3/02; D05C 15/10; D05B 85/02

[52] U.S. Cl. ..... 112/80.16; 112/222

[58] Field of Search ..... 112/80.4, 80.45, 112/88.16, 80.05, 222, 224, 225

[56] References Cited

U.S. PATENT DOCUMENTS

| | | | |
|---|---|---|---|
| Re. 4,002 | 5/1870 | Carpenter | 112/224 |
| 3,753,412 | 8/1973 | Shepard et al. | 112/222 |
| 5,735,299 | 4/1998 | Kaltenbach | 112/224 X |
| 6,062,151 | 5/2000 | Meade et al. | 112/80.16 |

FOREIGN PATENT DOCUMENTS

| | | | |
|---|---|---|---|
| 26286 | 3/1922 | France | 112/224 |
| 539946 | 8/1926 | France | 112/224 |
| 158892 | 8/1985 | Japan | 112/222 |
| 824818 | 11/1956 | United Kingdom | 112/222 |
| 129712 | 3/1969 | United Kingdom | 112/222 |

*Primary Examiner*—Ismael Izaguirre
*Attorney, Agent, or Firm*—Alan Ruderman; Stephen J. Stark

[57] ABSTRACT

A tufting needle construction in which the mounting shank is offset from the axis of the blade and the yarn guide groove which extends to the eye and point portion of the needle. The yarn guide groove extends from a yarn entry mouth spaced from the shank so that yarn entering the groove from the mouth lies entirely within the groove and does not feed into the groove at an angle. Accordingly, when the needle pierces a backing material during the tufting process, the yarn is not crushed between the blade and the backing material. In one embodiment the shank is perpendicular to the blade. In another embodiment the shank has a first portion perpendicular to the blade and another portion parallel to the blade.

7 Claims, 2 Drawing Sheets

TUFTING MACHINE NEEDLE

BACKGROUND OF THE INVENTION

This invention relates to a needle for a tufting machine and more particularly to a needle wherein the shank or mounting portion thereof is offset from the blade of the needle so that the yarn guide groove that extends along the blade from the eye opens at a mouth which is in line with the groove and does not intersect the shank.

Needles for a tufting machine are well known. See for example U.S. Pat. Nos. 3,954,072 and 4,194,457, and German Patent No. 3,545,692. Such needles are used mainly in machines which manufacture floor coverings such as carpet. In such needles, in order to thread the yarn into the eye of the needle, it is necessary for yarn to be fed into an elongated yarn feed or guide groove in the needle body, the yarn passing down the groove and into the eye of the needle. With these known needles, the top of the yarn guide groove opens onto the side of the needle body which necessitates yarn being fed into the groove at an angle. Due to this angular feed of yarn into the yarn feed groove, during piercing of the backing material by the needle during operation of the tufting machine, the yarn can be damaged either because it is not lying correctly or completely in the yarn guide groove which can cause the yarn to be crushed between the needle body and the backing material during piercing of the backing material by the needle. This is particularly a problem where the backing material is relatively hard. A further consequence of the yarn not being correctly in the yarn feed groove is that the hole punctured in the backing material can be elongated by the yarn which results in a detraction of the appearance of the finished tufted fabric. Furthermore, problems may also arise due to backstitch retention, variation of the level of tufts in loop or cut pile, both of which also lead to a detraction in appearance in the finished fabric.

In order to alleviate this problem, a tufting needle has been proposed in the prior art in which a top part of the needle is generally offset from and substantially parallel to the needle body, and in the region of this offset, a second eye of the needle is formed, as an extension of the yarn guide groove formed in the needle body. This additional eye of the needle in conjunction with the yarn guide groove and the eye of the needle permits good guidance of yarn, but experience has shown that due to the weakening of the material of the needle by the presence of the second eye, there is a greater likelihood of needle breakage in this region of the needle. A further problem with a double-eyed needle of this type is that it can be extremely difficult to thread when used in a fine gauge configuration and almost impossible to thread when a staggered needle arrangement is used. A still further problem arises due to the elongation of the punctured hole in the backing material since this can give rise to a weakening of the tufted fabric. This can particularly give rise to problems when, for example, the tufted fabric is required to be molded, such as in the automobile industry.

SUMMARY OF THE INVENTION

Consequently, it is a primary object of the present invention to provide a needle for tufting machines which increases the likelihood of reliable yarn guidance and which is strong enough to be used in conjunction with tufting into all kinds of backing materials.

It is another object of the present invention to provide a needle in which the yarn is guided along a groove that is not angularly disposed relative to the direction the yarn enters the groove.

Accordingly, the present invention provides a needle for a tufting machine comprising a mounting part or shank for mounting a needle relative to a needle bar or module, a needle body or blade linked to the shank and terminating in a point, the blade being provided with a needle eye in proximity to said point, the blade having an elongated yarn guide groove provided therein extending intermediate the shank and the needle eye, wherein at least a part of the shank is disposed at an angle to the needle blade and the yarn feed or guide groove is substantially straight and terminates in an open mouth into which yarn may be fed.

With a needle constructed in accordance with the present invention, it is possible to feed yarn straight down the yarn guide groove and into the eye of the needle. There is thus no angular feed of yarn into the yarn feed groove, thereby reducing the likelihood of yarn lying outside the groove and thereby allowing the problems identified above to be overcome.

A further advantage of a needle constructed in accordance with the present invention is that since there is no compromise in the thickness or strength of the material of the needle as there is with prior art needles mentioned above, a needle according to the present invention is suitable for use with a great number of backing materials including those which are relatively hard.

Preferably, at least a portion of the shank of the needle extends substantially perpendicular to the needle blade. In one form of the invention, the shank is generally L-shaped, a first part thereof extending generally perpendicularly to the blade and a second part extending generally parallel to, but spaced from, the blade.

Moreover, in use, an additional yarn guide device may be used to assist in guidance of yarn into the open mount of the yarn feed groove and may be secured to the module in which the needle is mounted so that the eye of the yarn guide device is directly above the mouth of the yarn guide groove.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
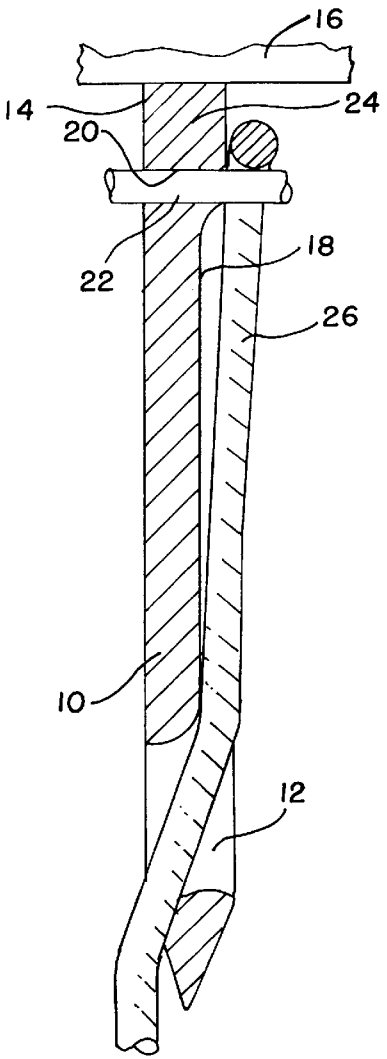
FIG. 1 is a side elevational view of one form of prior art needle having a yarn guide groove which opens out to one side of the needle.

Referring now to the drawings, there is illustrated in FIG. 1 a known form of prior art tufting needle 10 which comprises a top mounting part or shank 12 of substantially circular cross-section which, in use, mounts the needle relative to a needle module or needle bar of a tufting machine (not illustrated). A body or blade 13 of a generally flattened cross-section is linked to the shank 12, which blade 13 terminates in a needle point 14 at a lower end remote from the shank 12. In close proximity to the needle point 14 is disposed an eye 15 of the needle through which yarn may be threaded as is notoriously well known in the art. A yarn feed or guide groove 16 is provided in the needle blade 13 and extends between the eye 15 and one side of the needle blade 13 and opens out below the shank at the side of the needle at an entrance mouth 18. In use, yarn is fed from above and enters the yarn guide groove 16 from the mouth 18 and passes down the yarn guide groove 16 to the eye 15. A recess 19 in the shank 12 may be formed for aiding and securing the needle in a needle module in those instances where needles are mounted in such modules, see for example FIGS. 3 and 4. Due to the position of the mouth 18, it can be seen that entry of the yarn into the yarn guide groove 16 must be effected at an angle. This renders it likely that problems will arise in feeding the yarn correctly into the guide groove 16. On the opposite side of the needle to the yarn guide groove 16 is a recess 20 known in the art as the clearance above the eye or C.A.E. which cooperates, in use, with a looper of the tufting machine to seize and capture the yarn for purposes of forming a yarn loop.

Figure 2:
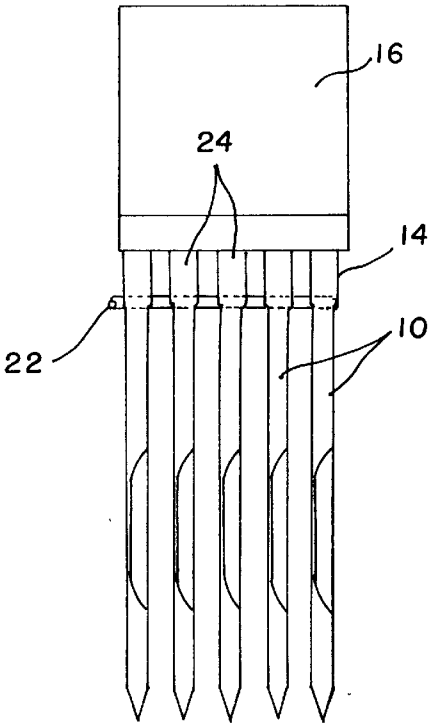
FIG. 2 is a side elevational view of one embodiment of a needle constructed in accordance with the present invention.

One embodiment of an improved needle constructed in accordance with the present invention is illustrated in FIG. 2. The needle here is generally of similar construction to the needle illustrated in FIG. 1, but has some major significant differences. While in the prior art needle illustrated in FIG. 1, the yarn feed or guide groove 16 opens out at one side of the needle blade 13 in the mouth 18, in the needle 100 illustrated in the embodiment of FIG. 2, an upper mounting part or shank 22 of the needle is angularly disposed relative to the needle blade 23 and the mouth 28 of the yarn guide groove 26 is in alignment with the remainder of the groove such that the yarn guide groove 26 is substantially straight from the eye 25 of the needle to the mouth 28 of the groove 26. The improved needle of FIG. 2 can simply be formed by taking the needle of FIG. 1 and causing the shank 12 to be moved into the position of the shank 22 illustrated in FIG. 2. This movement can be achieved in any suitable manner. for example, by bending at the location 21 so that the shank 22 and recess 29 are substantially perpendicular to the blade 23. It will thus be appreciated that the mouth 28 and guide groove 26 move to the position shown in FIG. 2, in which the yarn guide groove 26 is substantially straight the entire length of the blade 23. The point portion from the eye 25 to the point 24 is substantially identical to the needle of the prior art.

It will therefore be appreciated that with the needle shown in FIG. 2, yarn can be threaded into the eye 25 of the needle directly from above straight down the yarn guide groove 26. Thus, with this needle there is less likelihood that a yarn misfeed will occur relative to prior art needles.

Figure 3:
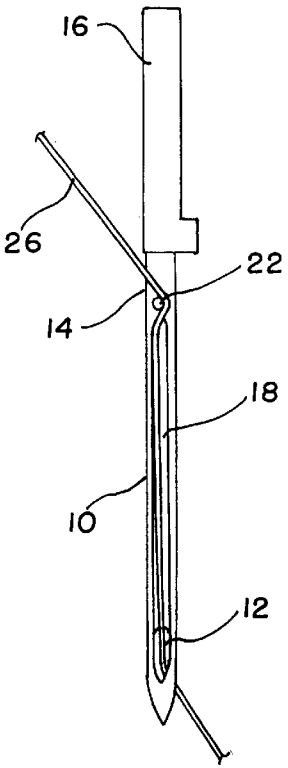
FIG. 3 is a side elevational view of the needle of FIG. 2 illustrated as mounted in a needle module for mounting on a needle bar of a tufting machine with an additional yarn guide device disposed above the needle.

FIG. 3 illustrates the needle of FIG. 2 molded within a needle module 30 which may have a plurality of such needles therein and may be mounted onto a needle bar of a tufting machine (not illustrated) in conventional manner by means of a screw which may be extended through a hole 30*a* in the needle module as is notoriously well known in the art and as illustrated, for example, in U.S. Pat. No. 4,138,956. In order to further provide assistance to the guidance and threading of the yarn in addition to the straight form of yarn guide groove 26, a yarn guide device 102 may be disposed above the mouth 28 of the yarn guide groove 26. In the particular example shown in FIG. 3, the yarn guide device 102 is also mounted in the needle module 30, however, the device 102 may be mounted relative to the mouth 28 of the yarn guide groove 26 in any suitable manner as desired or appropriate. The yarn guide device 102 includes a yarn guide eye 104 through which the yarn is guided in a substantially straight path directly from a yarn supply or from a yarn guide on the tufting machine (not illustrated) to the mouth 28 of the yarn guide groove 26 of the needle.

It will be appreciated that the presence of the additional yarn guide device 102 and the substantially straight yarn guide groove 26 renders it considerably less likely that a yarn misfeed will occur than in the prior art needle shown in FIG. 1.

Figure 4:
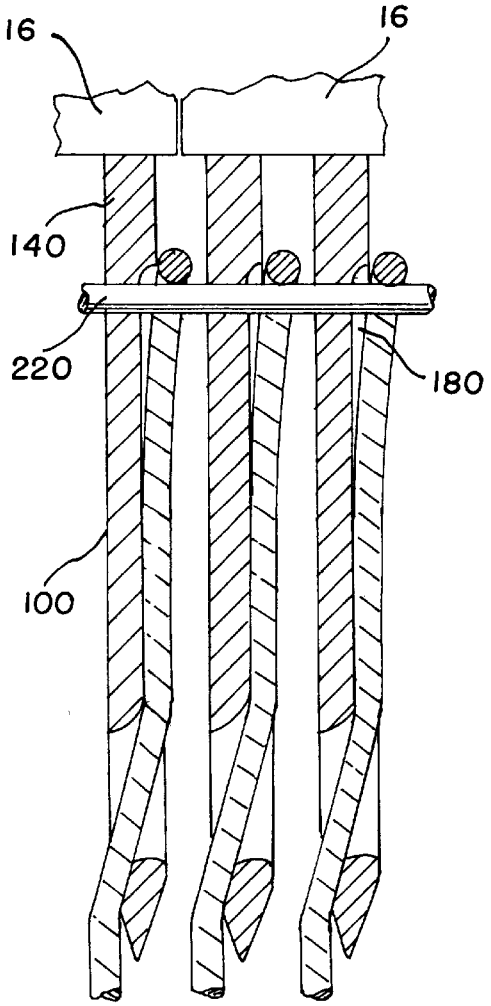
FIG. 4. is a view similar to FIG. 3 of a second embodiment of a tufting needle constructed in accordance with the present invention and a needle module adapted to be mounted on the needle bar of a tufting machine.

Referring now to FIG. 4, there is shown a second embodiment of a needle 100 constructed in accordance with the present invention. In this needle, the shank or top mounting part 22 is formed in a substantially L-shaped, one arm 32 of which extends substantially at right angles to the needle blade 23 and the other arm 34 of which extends substantially parallel to, but spaced from, the needle blade 23. With this embodiment of the needle 100 the arm 34 of the shank 22 is mounted in the needle module 28 or a needle bar of the tufting machine whereby the needle blade 23 extends downwardly from the module or needle bar, and by sizing the length of the arm 32 of the arm 32 such that it is longer than the space from the front 30*b* of the module to the arm 34, the needle blade 23 is disposed spaced from the front 30*b* of the module or needle bar such that the mouth 28 of the yarn guide groove 26 is easily accessible from above for feeding of yarn. This insures that there is also little likelihood of yarn misfeeds in this embodiment also. In all other respects the needle illustrated in FIG. 4 is the same as that illustrated in FIG. 3.

Figure 5:
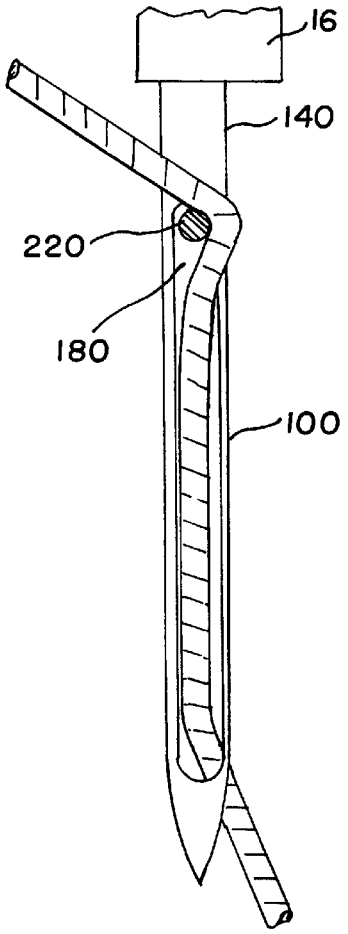
FIG. 5 is a side elevational view of the needle illustrated in FIG. 2 shown mounted in a tufting machine utilizing a needle mounting device.

FIG. 5 shown a third embodiment of the needle in accordance with the present invention. This embodiment of the needle is generally similar in form to the needle shown in FIG. 2 except for the fact that no recess 29 is present in the mounting shank 42. This is because the form of needle is intended to be used with a different form of mounting within a tufting machine. Conventionally, in a tufting machine, needles are mounted either in modules which are attached to a needle bar, or directly into the needle bar itself. The embodiment of the needles shown in FIG. 5 is intended to be used with a needle mounting which comprises a generally plate or sheet-like support 45 in which there is provided a plurality of spaced holes 44. With this mounting, the needle blade 43 of the needle passes through a selected one of the plurality of holes 44 and the shank 42 which is substantially at right angles to the needle blade 43 abuts the top of the needle mounting 45 thereby retaining the needle in position. It may thus be seen that with such a needle mounting, the needles may be positioned in any desired position by mounting them in a selected one of the holes in the mounting. It may also be necessary to align the needles in the mounting 45 in a particular angular orientation relative to the hole. To achieve this, grooves 46 are provided in the surface of the needle mounting 45 and are angularly spaced around such holes. Therefore, in use, the shank 42 of the needle 100 can rest in a pre-selected one of the grooves 46 in the top surface of the mounting in order to restrain the needles from twisting or other movement relative to the looper. Once received within the groove, the needle is fixed by clamping or fasteners in a particular angular disposition relative to the looper.

The embodiments of the needle of the present invention described enable reliable and accurate yarn feed from a yarn supply to a yarn guide or groove provided in the needle. This is achieved by providing the yarn guide groove in substantially straight form with an open mouth which is in alignment with the remainder of the yarn guide groove. This insures that it is relatively simple to provide that the yarn is fed correctly into the yarn guide groove. This it will, of course, be appreciated reduce or eliminate the problems heretofore mentioned. A further advantage of the arrangement of the present invention is that there is no material. weakening of the blade of the needle such that there is reduced likelihood of the needle breaking, thereby rendering the needles of the invention suitable for all areas of application and for tufting through backings of all materials.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A needle for tufting including a substantially straight elongated blade having a longitudinal axis, an eye and point portion including a transverse eye connected to said blade and terminating in a tip, said blade having a longitudinal groove with an axis of elongation commencing at a mouth and terminating at said eye, said groove being substantially straight between said eye and said mouth with said eye and said mouth disposed along the axis of elongation of said groove, a shank remote from said tip for mounting said needle, said shank being offset relative to said blade and including a portion substantially perpendicular to said axis so that said groove does not intersect said shank and said mouth is spaced from said shank.

2. A needle as recited in claim 1, wherein said shank includes a portion which is spaced from and substantially parallel to said axis of said groove.

3. A needle as recited in claim 1, wherein said shank is substantially perpendicular to said axis of said groove.

4. A needle as recited in claim 1, wherein said shank is molded within a module, said shank having a recess formed therein for aiding in securing said shank in said module.

5. A needle as recited in claim 1, wherein said shank is molded within a module and said module includes a yarn guide spaced above said blade, said guide having an eye disposed directly above said mouth.

6. A needle as recited in claim 5, wherein said shank includes a recess formed therein for aiding in securing said shank in said module.

7. A needle as recited in claim 5, wherein said shank includes a portion which is spaced from and substantially parallel to said axis of said groove.

* * * * *

UNITED STATES PATENT AND TRADEMARK OFFICE

CERTIFICATE OF CORRECTION

PATENT NO. : 6,152,055
DATED : November 28, 2000
INVENTOR(S) : Ian Beverly

It is certified that error appears in the above-identified patent and that said Letters Patent is hereby corrected as shown below:

Figures 1 through 5 should be replaced with Figures 1 through 5 as provided below:

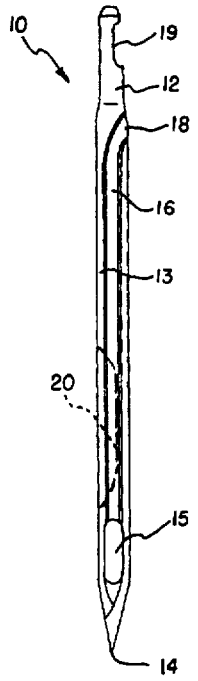

FIG. 1
PRIOR ART

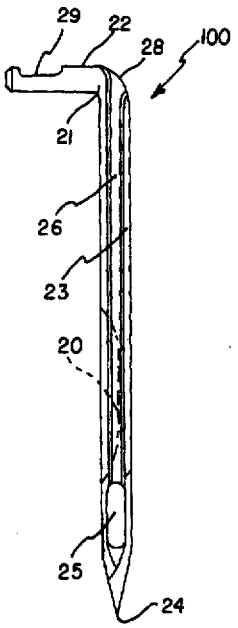

FIG. 2

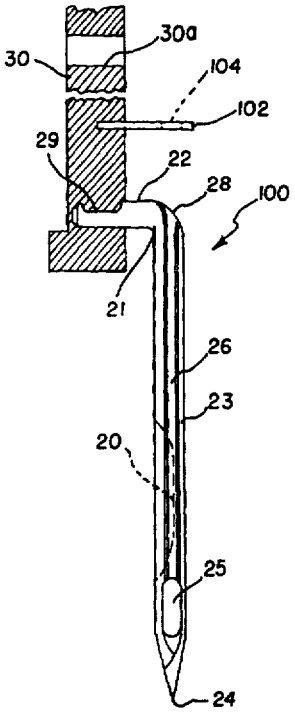

FIG. 3

UNITED STATES PATENT AND TRADEMARK OFFICE

CERTIFICATE OF CORRECTION

PATENT NO. : 6,152,055
DATED : November 28, 2000
INVENTOR(S) : Ian Beverly

It is certified that error appears in the above-identified patent and that said Letters Patent is hereby corrected as shown below:

Figures 1 through 5 should be replaced with Figures 1 through 5 as provided below:

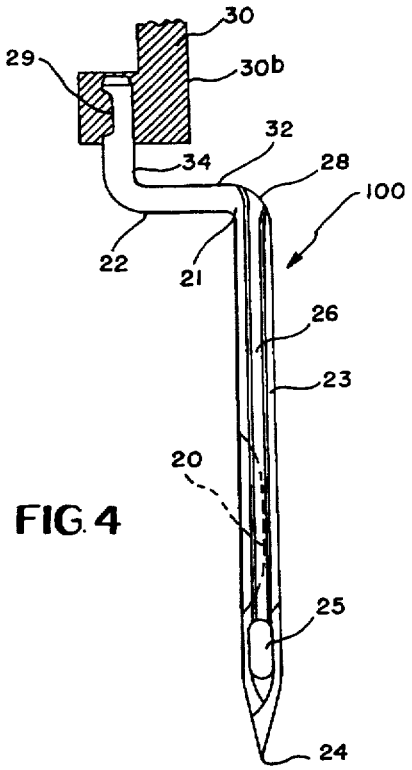

FIG. 4

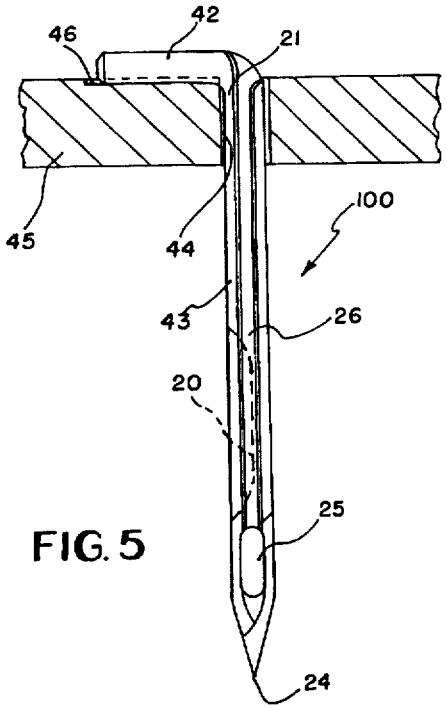

FIG. 5

Signed and Sealed this

Sixth Day of November, 2001

*Attest:*

Nicholas P. Godici

*Attesting Officer*

NICHOLAS P. GODICI
*Acting Director of the United States Patent and Trademark Office*